United States Patent [19]

Cobaugh

[11] Patent Number: 4,781,602

[45] Date of Patent: Nov. 1, 1988

[54] ELASTOMERIC SUPPLEMENT FOR CANTILEVER BEAMS

[75] Inventor: Robert F. Cobaugh, Elizabethtown, Pa.

[73] Assignee: AMP Incorporated, Harrisburg, Pa.

[21] Appl. No.: 54,652

[22] Filed: May 27, 1987

Related U.S. Application Data

[60] Division of Ser. No. 843,344, Mar. 24, 1986, abandoned, which is a continuation of Ser. No. 237,334, Feb. 23, 1981, abandoned.

[51] Int. Cl.[4] ..... H01R 13/52

[52] U.S. Cl. ..... 439/82; 439/521; 439/936; 439/937; 439/857

[58] Field of Search ..... 439/81–83, 439/276, 278, 389, 519, 743, 885, 936, 937, 851–853, 856, 857, 521

[56] References Cited

U.S. PATENT DOCUMENTS

| | | | |
|---|---|---|---|
| 2,963,775 | 12/1960 | Chadwick | 439/885 |
| 3,156,517 | 11/1964 | Maximoff et al. | 439/743 |
| 3,803,537 | 4/1974 | Cobaugh et al. | 439/844 |
| 3,865,459 | 2/1975 | Mills | 439/872 |
| 3,877,769 | 4/1975 | Berg et al. | 439/83 |
| 3,899,232 | 8/1975 | Berg et al. | 439/519 |
| 4,012,107 | 3/1977 | Cobaugh et al. | 439/82 |
| 4,083,623 | 4/1978 | Lynch | 439/83 |
| 4,149,768 | 4/1979 | Wise | 439/730 |
| 4,171,856 | 10/1979 | Lynch | 439/82 |
| 4,384,757 | 5/1983 | Andrews, Jr. et al. | 439/736 |
| 4,391,482 | 7/1983 | Czeschka | 439/590 |

OTHER PUBLICATIONS

IBM Bulletin, "Barrel Connector", vol. 14, No. 9, Feb. 1972, By B. R. Kryzaniwsky.

*Primary Examiner*—Gil Weidenfeld
*Assistant Examiner*—Gary F. Paumen
*Attorney, Agent, or Firm*—Allan B. Osborne

[57] ABSTRACT

The invention relates to the forces generated in the cantilever beam type contacts by deflecting pins or leads. More particularly, the invention teaches associating the cantilever beam with an elastomer which supplements the beam's capability of exerting force due to being deflected.

5 Claims, 2 Drawing Sheets

ELASTOMERIC SUPPLEMENT FOR CANTILEVER BEAMS

This is a division of application Ser. No. 843,344, filed Mar. 24, 1986, now abandoned, which is a continuation of Ser. No. 237,334, filed Feb. 23, 1981, now abandoned.

BACKGROUND OF THE INVENTION

1. The Field of the Invention

This invention relates to spring forces generated in a resilient material by a deflecting force and to means for supplementing such forces.

2. The Prior Art

No art specifically relating to the use of an elastomer as a supplemental spring force in a spring socket having cantilever beams is known to applicant. U.S. Pat. No. 3,877,769 does teach applying a viscous liquid silicone rubber in the opening of a socket. After curing, the rubber provides a seal which prevents flux, molten solder or other contaminants from entering the interior of the socket.

SUMMARY OF THE INVENTION

This invention discloses a means by which the spring force of a deflected cantilever beam may be altered. More particularly, the invention discloses using an elastomer behind the beam so that spring forces are generated both in the beam and in the elastomer by a load.

DESCRIPTION OF THE INVENTION

Figure 1:
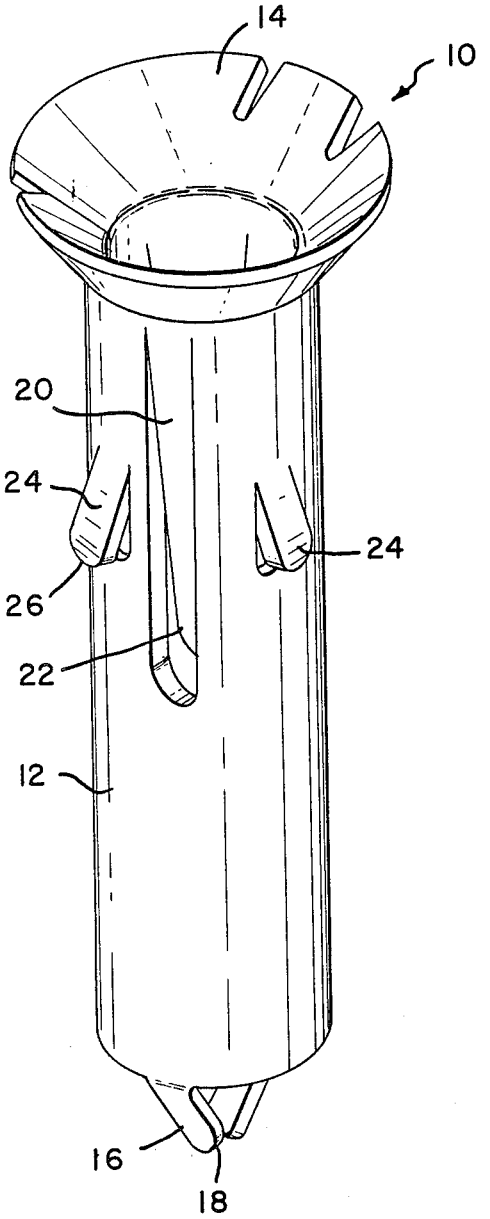
FIG. 1 is a perspective view of a printed circuit board spring socket with which the present invention is illustrated.

Spring socket 10 shown in FIG. 1 has a cylindrical body 12, a flared rim 14 on top of the body and three fingers 16 forming a bullet like tip 18 on the lower end of the body.

Three cantilever beams 20 are formed from body 12 and the free ends 22 pushed into the interior thereof. The upper end of the beams remain attached to the body. Three short lances 24 are also formed from the body and their free ends 26 are pushed out away therefrom.

Figure 2:
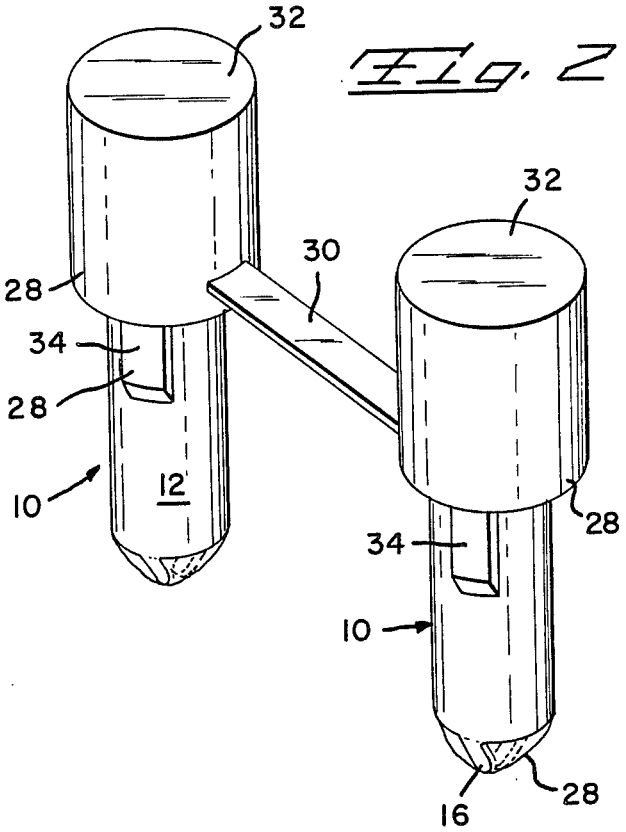
FIG. 2 shows in perspective a pair of FIG. 1 sockets subsequent to being encapsulated in an elastomeric material.

FIG. 2 shows a pair of sockets 10 which have been filled and partially encapsulated in an elastomer indicated by reference numeral 28. Preferably the elastomer is a liquid injectable silicone rubber.

The elastomer is applied to the sockets with the sockets in a mold (not shown). Where a number of sockets are receiving the elastomer in a continuous molding process, a connecting strip 30 of the elastomer joining adjacent encapsulated sockets may be provided. Such a carrier strip would provide many benefits in handling, storing, and inserting the sockets into circuit boards.

Figure 3:
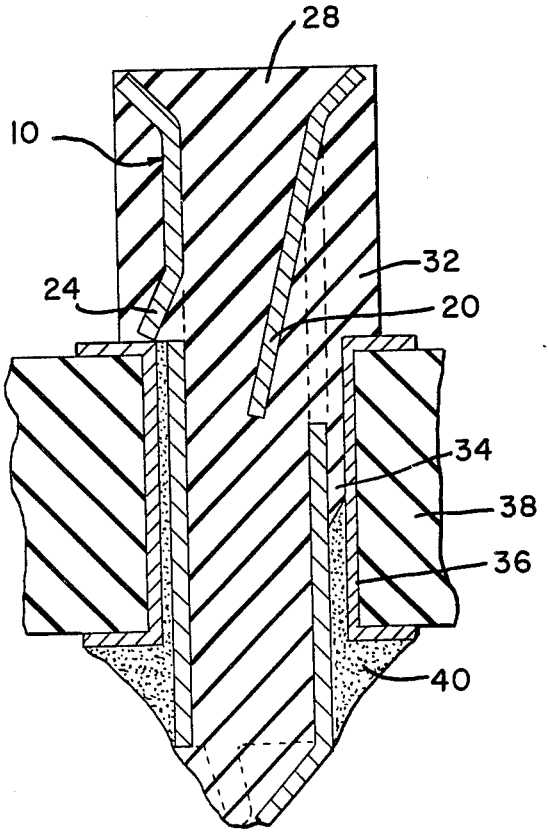
FIG. 3 is a cross-sectional view of a FIG. 2 socket subsequent to being soldered in a hole in a printed circuit board.

As shown in FIGS. 2 and 3, the elastomer completely fills and encapsulates the upper part of the socket, with the outer jacket 32 extending down to free end 26 of lances 24. Obviously, the presence or absence of an outer jacket depends on the nature of the device receiving the elastomer. Additionally, and for the present application a number of ribs 34 (of elastomeric material) extend down below jacket 32. The ribs and outer jacket back up the elastomeric material supporting the beams. The ribs abut the walls of plated-through hole 36 in circuit board 38 (FIGS. 3 and 4) so that the walls can provide a firm support for the elastomeric material. Where the elastomeric material is thick enough, the thickness itself provides the support.

Figure 4:
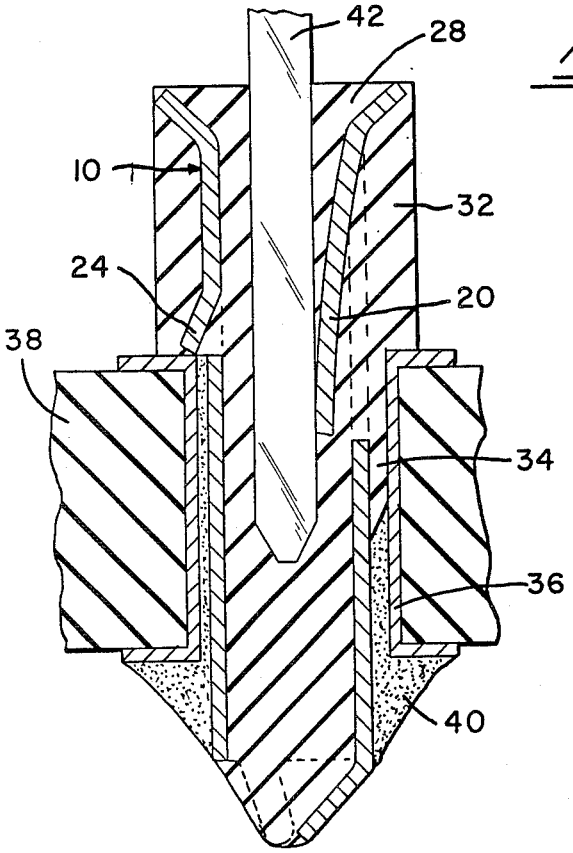
FIG. 4 is the same cross-sectional view as FIG. 3 but with a pin or lead inserted into the socket causing a deflection in the cantilever beam and compression in the elastomer.

As seen in FIGS. 3 and 4, the elastomer fills the interior of socket 10 and particularly behind cantilever beams 20.

FIGS. 3 and 4 also show the encapsulated socket positioned and soldered in hole 36. The solder is indicated generally by reference numeral 40. The soldering and cleaning operations (not shown) have not caused degradation of the elastomer.

FIG. 4 shows a pin 42 inserted into encapsulated socket 10. The pin has pierced the elastomer and further has displaced it from cantilever beams 20 at the point of contact so that an electrical path between the pin and socket is made. As the pin is driven into the socket it engages the beams and bends or deflects them outwardly. The deflection is also seen by the elastomer which is resilient as noted above. The importance of this is that beams 20 can be made thinner than if they alone had to absorb the deflection imposed by pin 42. Other parameters which can be changed include beam length, beam material and amount of beam deflection.

Other advantages flow from the present invention. In that the elastomer does not tear when a pin or lead is inserted, it flows back together upon pin withdrawal. Accordingly, the interior of the socket and the contact between pin and beams are environmentally sealed notwithstanding the number of times the elastomer is pierced. Warpage of the circuit board from handling or thermal shock would be absorbed by the elastomer and not transmitted to the electronic device plugged into the sockets.

Figure 5:
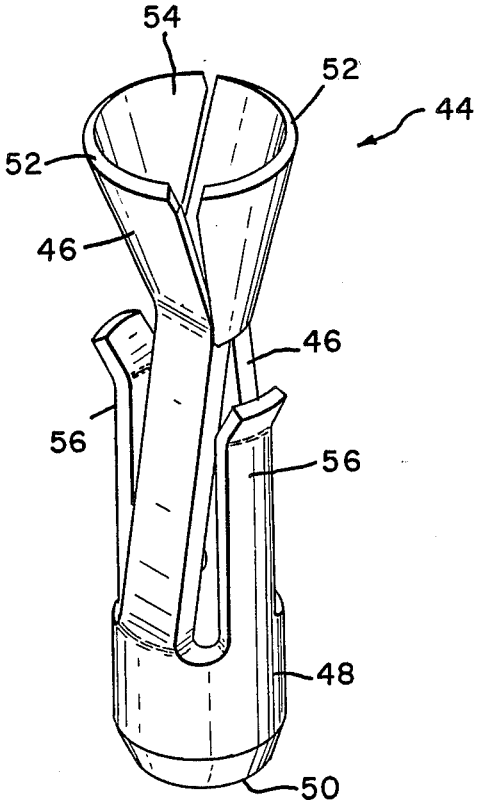
FIG. 5 is a perspective view of another type of spring socket.

FIG. 5 illustrates a second type of socket 44 having a pair of spring arms 46 which are attached to body 48 near lower end 50. The free ends 52 of the arms are flared out to define a bell-mouth opening 54 to the socket's interior. Downwardly from the free ends the arms converge to form a narrow opening into the socket. The body also carries a pair of spring fingers 56 which centralize and hold the socket in hole 36 during the soldering operation.

Figure 6:
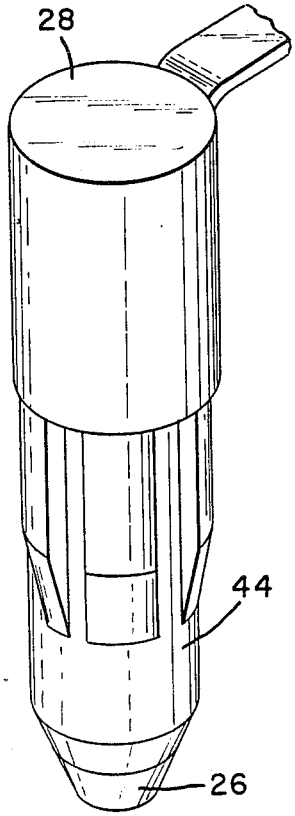
FIG. 6 shows the FIG. 5 socket encapsulated in an elastomeric material.

FIG. 6 shows the socket after being filled and partially encapsulated by elastomer 28. As with socket 10, the elastomer encapsulates the upper part of the socket. In this case, the encapsulation both seals the opening and provides a supplementary spring to spring arms 46. Thus, as a pin (not shown) is inserted into the socket, it contacts the spring arms at the nearest point of convergences and forces them outwardly. This compressive force is also absorbed by the elastomer as noted above.

The preferred elastomer is a liquid injectable silicone rubber having a cured durometer of about forty (40).

The present invention may be subject to many modifications and changes without departing from the spirit or essential characteristics theref. The present embodiment should therefore be considered as illustrative and not restrictive of the scope of the invention.

What is claimed is:

1. Spring sockets for insertion into holes in a circuit board and for receiving thereinto conductive pins extending outwardly from electronic components, each of said sockets comprising conductive, elongated hollow body means having concave-convex shaped spring arms attached to one end and extending axially therefrom with free ends thereon forming, in cooperation with each other, an opening and further, with the convex surfaces of said spring arms defining contact areas for engaging conductive pins inserted into said opening, said sockets further including cap means of elastomeric material encapsulating one end of said body means.

2. The spring sockets of claim 1 further including thin, flexible connecting strips attached to and extending between said cap means on adjacent sockets.

3. The spring sockets of claim 1 further including ribs of elastomeric material extending along said body means from said cap means.

4. The spring sockets of claim 1 wherein said elastomeric material extends into the interior of said body means.

5. The spring sockets of claim 4 wherein said elastomeric material encapsulates said spring arms thereby adding spring force thereto.

* * * * *